US008051542B2

(12) United States Patent
Buday

(10) Patent No.: US 8,051,542 B2
(45) Date of Patent: Nov. 8, 2011

(54) DETACHABLE LANYARD BUCKLE

(76) Inventor: Alexander Buday, Nitra (SK)

( * ) Notice: Subject to any disclaimer, the term of this patent is extended or adjusted under 35 U.S.C. 154(b) by 179 days.

(21) Appl. No.: 12/228,531

(22) Filed: Aug. 13, 2008

(65) Prior Publication Data

US 2010/0037437 A1 Feb. 18, 2010

(51) Int. Cl.
*A44B 11/25* (2006.01)

(52) U.S. Cl. ..... 24/615; 24/625; 24/323; 24/3.13

(58) Field of Classification Search ..... 24/614, 24/615, 625, 3.13, 3.12, 323, 313
See application file for complete search history.

(56) References Cited

U.S. PATENT DOCUMENTS

| | | | | |
|---|---|---|---|---|
| 4,945,614 | A | 8/1990 | Kasai | |
| 5,311,649 | A | 5/1994 | Suh | |
| 5,791,026 | A | 8/1998 | Anscher | |
| 5,832,573 | A | 11/1998 | Howell | |
| 5,938,137 | A | 8/1999 | Poulson | |
| 6,615,460 | B1 | 9/2003 | Baumgarten | |
| 6,622,355 | B2 * | 9/2003 | Buscart et al. | 24/615 |
| 6,760,958 | B2 * | 7/2004 | Tejima | 24/616 |
| D520,738 | S | 5/2006 | Tarantino | |
| D521,726 | S | 5/2006 | Tarantino | |
| 7,194,787 | B2 * | 3/2007 | Murai et al. | 24/615 |
| 2002/0040514 | A1 * | 4/2002 | Uehara et al. | 24/614 |
| 2008/0134479 | A1 * | 6/2008 | Kolasa et al. | 24/625 |
| 2009/0007391 | A1 * | 1/2009 | Uehara | 24/32 |

OTHER PUBLICATIONS

Anonymous; *Advertising Materials*; www.lanyardsupply.com (9 pages) Jan. 16, 2009.

* cited by examiner

*Primary Examiner* — Robert Sandy
*Assistant Examiner* — Michael Lee
(74) *Attorney, Agent, or Firm* — James Creighton Wray

(57) ABSTRACT

Male and female parts of a buckle have mating shapes which together form ears and depressed eyes of an animal face. The male part has the shape of an anchor with eyes which slide into grooves to lock the parts, and ears which project upward from a slot in the cylindrical female part. Hooks on the female part back secure a cord loop which extends from the female part. A cover snaps on the back of the female part.

9 Claims, 5 Drawing Sheets

A

B

C

DETACHABLE LANYARD BUCKLE

FIELD OF THE INVENTION

This invention relates generally to a lanyard connector, more particularly to easy detachable three-part buckle with a system of elements for winding a string (cord) to eliminate the swinging effect.

BACKGROUND OF THE INVENTION

The connectors and buckles are commonly used to join the ends of belts, straps, bands and other such linear elements together. The buckles come in a variety of designs and have diverse characteristics such as being adjustable, quick-closing, and quick-opening. From among quick-opening or quick-release buckles, hook and loop fasteners are quite popular because they contain no metal, are generally immune to harsh treatment, and are resistant to most elements such as wind, rain, snow and the like. The buckles comprising two interlocking parts are well known (see U.S. Pat. Nos. 4,945,614; 5,311,649; 5,791,026; 5,832,573). The patents describe buckles having insert (male) and receptacle (female) parts.

U.S. Pat. No. 6,615,460 discloses a male/female-type buckle for belts and lanyards, wherein the insert member can be releasably inserted into the receptacle member and is locked in place be means of two resilient opposed lateral arms extending away from the center of the insert. The arms compress upon insertion, thereby providing a spring loading potential energy for their outward expansion. The arms move into locking slots on the body of the receptacle upon full insertion of the insert and spring out into the locked position within the slot.

The female part of such type of a buckle can be adopted to attach an accessory's string (eg. cell phone, USB flash, digital camera, ID cards etc.).

As a disadvantage, this type of buckle does not allow for adopting the length of the accessory's string, which results in undesirable swinging effect of the hung accessory.

U.S. Pat. No. 5,938,137 discloses a leash attached to the cell phone case and including a spring retractable leash cord in a housing pivotally attached to the belt that will prevent dropping and damage to a cell phone in a case clipped to the belt. The leash housing is pivotally attached to a locking belt hook that cannot easily be accidentally removed.

Though this type of clipping the cell phone partly eliminates the swinging effect of the hung cell phone, it makes a free manipulation with the cell phone more difficult. Further, the leash housing is exposed to a mechanical strain and thus also to detrition. This detrition dramatically increases when using inadequate pulling force, the real limit of which can very hardly be determined and is different for each user, but it causes an irreversible damage of the leash housing.

Further, it is known that the cords that are used for attaching the accessory to the buckle often have a metal ending, or also a small metal ring, by means of which they are attached to female members of buckles, thus increasing the material demands for their manufacturing.

SUMMARY OF THE INVENTION

This invention describes a detachable lanyard male/female-type buckle with a system of elements for winding a cord (string). It is an insert type of buckle and alike the other inventions, the inserting (male) member can be detachably inserted into the casing (female) member and fixed/locked by the protrusions of arms. Along with an inserting (male) member, the buckle according to this invention comprises a casing (female member) having a system of elements for winding a cord and a cover of casing.

The male member of the buckle consists of a central part—body—having flexible arms disposed on both its sides, which extend from the bottom end of the body upwards. The body of the insert member with arms is intended to be attached to the casing (female part) of the buckle.

The female member of buckle (casing) is designed as a shaped hollow housing having a circular section, and having one (upper) end open and the other (bottom) end closed.

The object of the invention is that the female member (casing) is in the upper end of the outer surface of the rear part equipped with a system of elements for winding a cord (string), which comprises a hanging element for attaching the cord of the accessory (e.g. cell phone, MP3 player, USB flash, digital camera, etc.), a peg ended with extended part and preferably a centring element for central fixing of the hung cord, which is situated in the bottom end, under the peg. Further, in the rear part of the casing there are two openings for inserting the shaped protrusions of flexible arms, and shaped fixing protrusions, which are situated next to the outer sides of the openings and serve for attaching the casing to the cover.

In another aspect of the invention, the casing is equipped with a cover with openings for inserting the shaped fixing protrusions of the rear part of the casing, which fixes the position of the cord (string). Also, on its bottom part the casing has a groove for guiding the cord and preferably the lateral grooves to facilitate opening of the cover in case of need for handling the cord.

In yet further aspect of the invention, the shaped hanging element with openings for lanyard, situated in the upper end of the male member (insert part) of the buckle, is preferably equipped with a flat element for opening the casing cover (a small lever).

As stated above, the male member of buckle consists of the central part—body—having flexible arms disposed on both its sides, which extend from the bottom end of the body upwards. The body of the insert member with arms is intended to be attached to the casing (female part) of the buckle.

On the upper part of the body of the insert member there is a shaped hanging element with an opening, serving for hanging the buckle on the lanyard, which can be together with the buckle preferably worn on the neck or wrist, as well as on the arm.

On its rear part the body is equipped with a longitudinal guide protrusion, which serves for providing a continual movement of the insert member and should prevent an incorrect inserting of the body with arms into the casing of the buckle. The flexible arms of the insert member are equipped with shaped "locking" protrusions, which are situated opposite to each other in the rear part of flexible arms.

The female member of buckle is designed as a shaped hollow housing having a circular section, and having one (upper) end open and the other (bottom) end closed. On the inner side of the front part there is a shaped guiding groove for inserting the body of the insert member, and on the inner side of the rear part there is a guiding groove for inserting the longitudinal protrusion of the body of the insert member.

In the rear part of the casing there are two openings for inserting the shaped protrusions of flexible arms. The surface between these openings and the guiding groove is shaped so as to facilitate guiding of the shaped protrusions of flexible arms and for their fixing.

After putting the insert (male) member into the grooves of the casing and its pressing inwards the casing, the arms move towards the body. When inserting the arms into the casing, the lateral surfaces of the shaped protrusions get into contact with lateral surfaces of the shaped surface of casing and when the inserting continues, the flexible arms are pressed further towards the body. When the insert part reaches the necessary depth, the pressed flexible arms return to their original position, the shaped protrusions snap in the relevant openings in the rear part of the casing, and by their upper surfaces they get into contact with the bottom surfaces of the shaped surfaces, thus providing attachment of the insert member to the casing.

After a standard attachment of the cord, which is part of the buckle, to the cell phone (or other type of accessory), the loop of the opposite end is hung on the hanging member of the casing. Preferably, the cord can be shortened to the desired length by its multiple winding on the peg, which is ended by an extended part, preventing the sliding of the cord from the peg. Further, under the peg there is preferably situated a centring member, serving for central positioning and fixing of the hung cord, thus eliminating a possibility of penetrating the cord (string) between the casing and the cover after closing the casing, as well as preventing an undesirable opening of the cover and subsequent slipping of the cord from the peg and hanging element by an uncareful handling.

After hanging and winding the cord to the system of elements for winding, a cover is attached to the casing, wherein the cord is put in the groove in the bottom part of the cover, thereby fixing the position of the cord. The cord can be shortened to a minimal length, thus maximally eliminating the swinging effect, and in order to conveniently handle the "accessory" it is sufficient to detach the female member from the male member. Moreover, the cord does not contain any further elements (e.g. metal or plastic end-pieces), thereby the manufacturing is simplified and material demands of the whole buckle are decreased.

By pressing the casing cover the shaped fixing protrusions move towards the central axis and subsequently reach the openings, thereby fixing the cover. When the cover reaches the desired site, the shaped protrusions return to the original position and fix the cover.

After opening the casing cover it is possible to freely handle the cord. The cover is opened simply—the male member is pulled out of the casing, the flat element is inserted in one of the grooves on the side of the cover and the cover is detached from the casing by soft levering.

The buckle is typically molded from a polyoxymethylene (POM), but it can also be made from other thermoplastic material. The aesthetic value of the buckle is increased also by the fact that the male member and female member will be available in various two-colour combinations and in graphical harmony with the impress on individual lanyards.

The advantage of the buckle according to the present invention is that it allows for winding the excessive length of the cord on the peg of the casing, thus eliminating the swinging effect when hanging the accessory on the cord. Even if a minimal length of the cord disturbes the overall impression, the solution according to the invention allows for enclosing the whole length of the cord in the casing. In such a case the function of the solution is increased by an aesthetic design of the buckle.

Moreover, after hanging the buckle on the lanyard the flat element for opening the cover is overlapped.

DESCRIPTION OF THE DRAWINGS

In the drawings which illustrate preferred embodiments of the invention

DETAILED DESCRIPTION OF PREFERRED EMBODIMENTS

The embodiment of the buckle according to the present invention will further be described with reference to the attached drawings.

Figure 1:
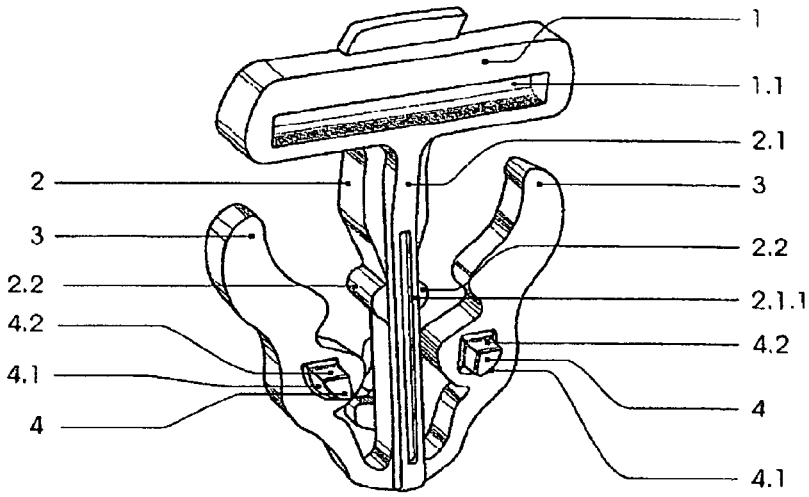
FIG. 1 is a prospective view on the insert (male) member of the buckle.
Figure 2:
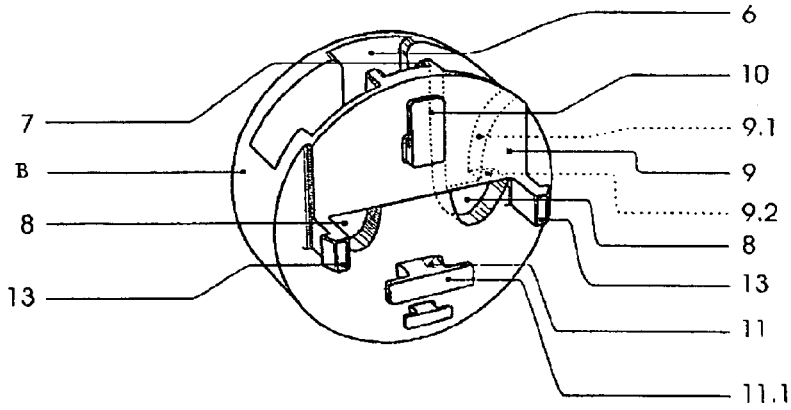
FIG. 2 is a prospective view on the casing (female member) of the buckle.
Figure 3:
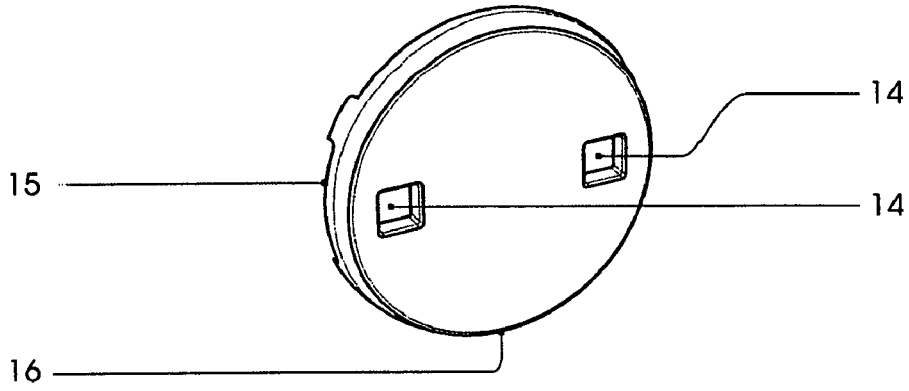
FIG. 3 is a prospective view on the cover of casing of the buckle.
Figure 5:
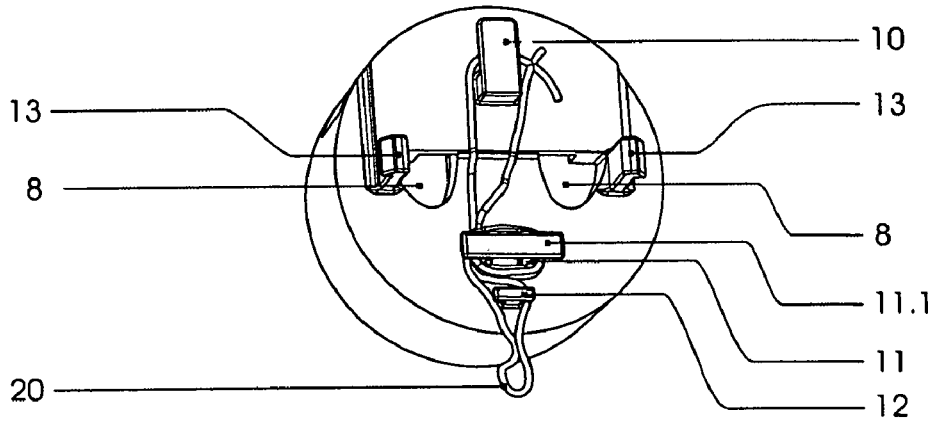
FIG. 5 is a rear prospective view on the rear part of the casing shown in FIG. 2 with winded string (cord)
Figure 4B:
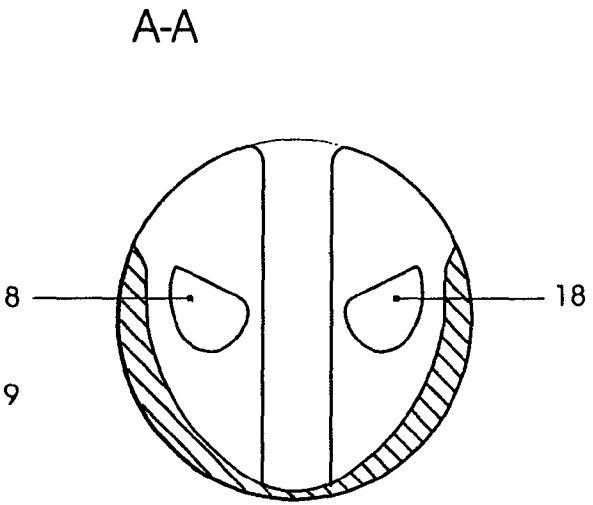
FIG. 4B is a front view on the inner side of the front part of the casing shown in FIG. 2.
Figure 4:
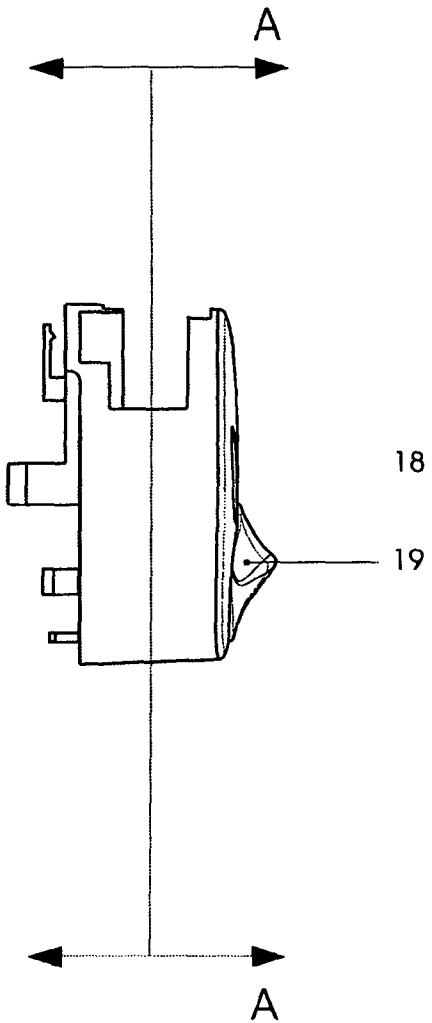
FIG. 4 is a side view on the casing.
Figure 4A:
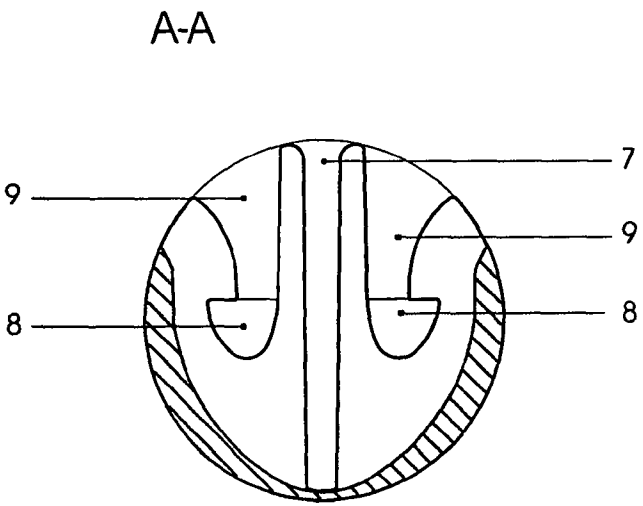
FIG. 4A is a front view on the inner side of the rear part of the casing shown in FIG. 2.
Figure 6:
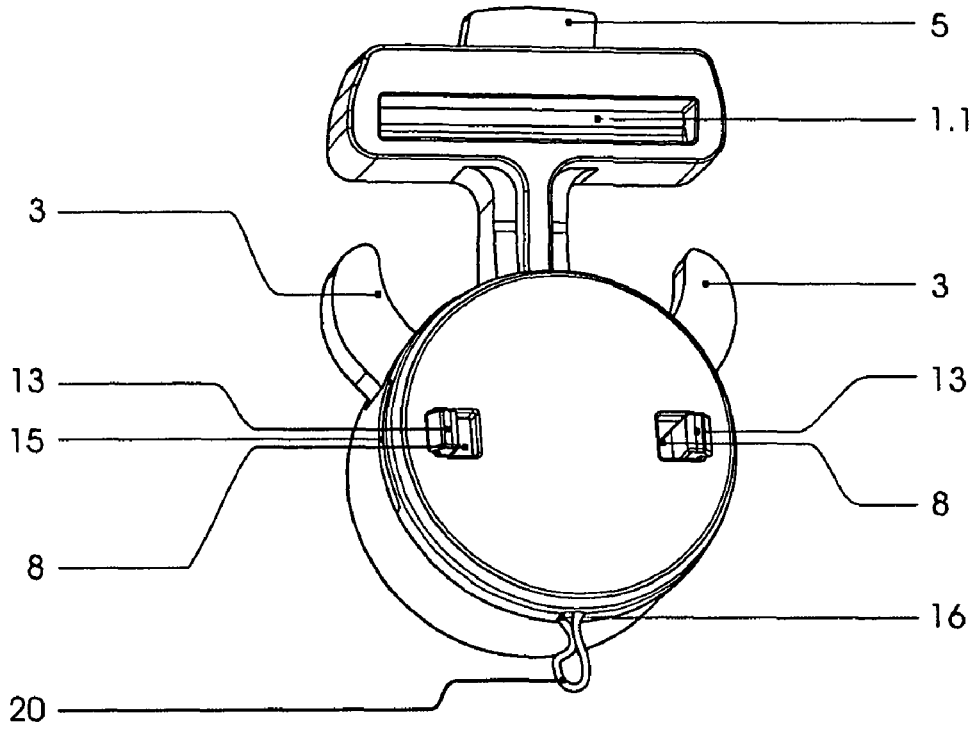
FIG. 6 is a rear prospective view on the assembled buckle with cover.

The buckle according to the present invention, showed in the unassembled state in the prospective view in FIGS. 1, 2 and 3, is an insert type buckle and it consists of the insert member (male member) A, casing (female member) B and cover C of casing. The insert (male) member A (FIG. 1) is intended to be inserted to the casing (female member) B (FIG. 2) with cover (FIG. 3). It is made from the polyoxymethylene (POM), but it can also be made from other thermoplastic material, in various colours, including combinations of colours.

The insert member A (male member) of the buckle consists of body 2 having flexible arms 3 disposed on both its sides, which extend from the bottom end of the body 2 upwards. The body 2 of the insert member A equipped with arms 3 is intended to be attached to the casing B of the buckle after its inserting in guiding grooves of the casing—in guiding groove 6 of the front part and guiding groove 7 of the rear part. On the upper part of the body 2 of the insert member A there is a shaped hanging element 1 with opening 1.1, which (opening) serves for passing the lanyard and hanging the buckle. On body 2 of the insert, approximately in the middle, there is preferably a shaped couple of protrusions 2.2, which limit movement of shaped arms 3 towards body 2 when inserting in the casing and pulling from the casing. Longitudinal guiding protrusion 2.1 on the rear part of the body 2 provides for a continuous movement of the insert member and prevents an incorrect inserting of body 2 with arms 3 in casing B of the buckle. In the longitudinal guiding protrusion 2.1 there can be a shaped longitudinal recess 2.1.1 for decreasing friction during inserting.

The flexible arms 3 of insert member A are equipped with shaped "locking" protrusions 4, which are situated opposite each other in one level on the rear part of flexible arms 3.

Figure 9:
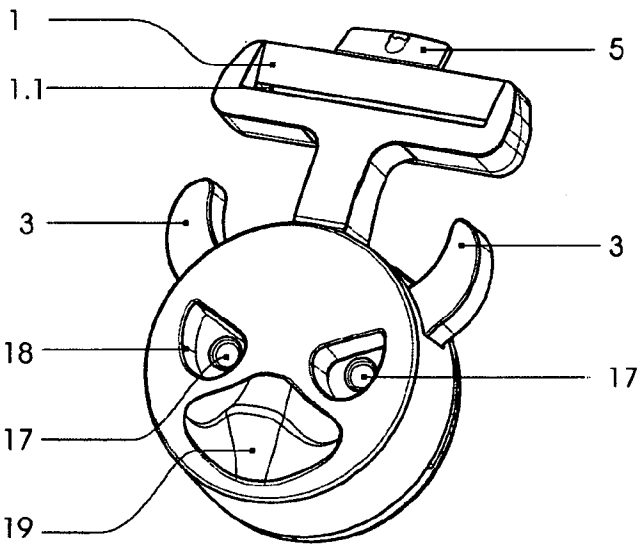
FIG. 9 is a front prospective view on the assembled buckle.
Figure 8:
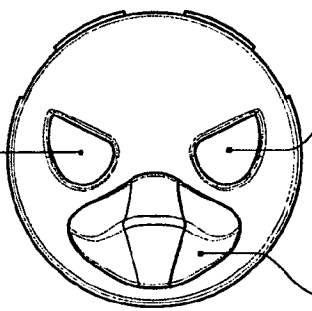
FIG. 8 is a front view on the front side of the casing of the buckle.
Figure 7:
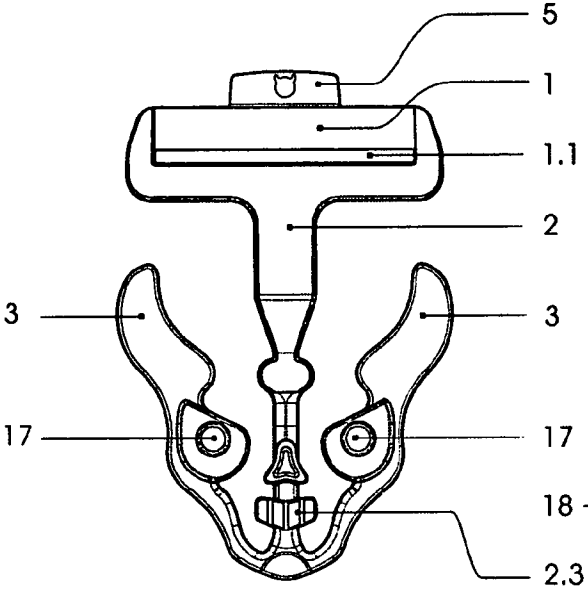
FIG. 7 is a front view on the front side of the insert (male) member shown in FIG. 1.

When inserting the arms 3 into the casing B the lateral surfaces 4.1 of the shaped protrusions 4 get into contact with lateral surfaces 9.1 of the shaped surfaces 9 of casing B and when the inserting continues, the flexible arms 3 are pressed further towards the body 2. When the insert part A reaches the necessary depth, the pressed flexible arms 3 return to their original position, the shaped protrusions 4 snap in the relevant openings 8 in the rear part of the casing B, and by their upper surfaces 4.2 they get into contact with the bottom surfaces 9.2 of the shaped surfaces 9, thus providing attachment of the insert member A to the casing B. A correct position of the insert member in the casing can also be identified according to the position of embossed protrusions 17 (FIG. 7) in the front part of arms 3, which are in case of a correct insertion visible as "eye" in the openings 18 (FIG. 8) in the front part of the casing B (FIG. 9).

The parts are detached by pressing the flexible arms 3 towards body 2 and pulling the insert part A from casing B.

The casing B is designed as a shaped hollow housing having a circular section. On the inner side of the front part there is a shaped guiding groove 6 for inserting the body 2 of the insert member, and on the inner side of the rear part there is a guiding groove 7 for inserting the longitudinal protrusion 2.1 of the body 2 of the insert member. Further, in the rear part of the casing there are two openings 8 for inserting the shaped protrusions 4 of flexible arms 3, and between openings 8 and guiding groove 7 there is a shaped surface 9 for guiding and fixing the shaped protrusions 4 of arms 3.

On the outer part of the rear part the casing B is equipped with shaped fixing protrusions 13, which are situated next to the outer sides of the openings 8 and serve for attaching the casing B to the cover C (FIG. 2). The front part of the casing is preferably equipped with openings 18 (FIG. 8), which can not only control a correct position of arms 3 of insert member together with a shaped beak-like element 19 and protruding ends of arms 3, but they also have an aesthetic function: after attaching the insert member to the casing they form a buckle in the shape of "duck".

Moreover, the casing B (female member) is in the upper end of the outer surface of the rear part equipped with a system of elements for winding a cord, which comprises a hanging element 10 for attaching the cord 20 with the accessory (e.g. a cell phone), a peg 11 ended with extended part 11.1 and preferably a centering element 12 for central fixing of the hung cord 20. This centering element 12 is situated in the bottom end, under the peg 11. Further, in the rear part of the casing there are two openings 8 for inserting the shaped protrusions 4 of flexible arms 3, and shaped fixing protrusions 13, which are situated next to the outer sides of the openings 8 and serve for attaching the casing B to the cover C.

The casing B comprises cover C with openings 14 for inserting the shaped fixing protrusions 13 of the rear part of the casing. By pressing the cover C the shaped fixing protrusions 13 are inclined towards the central axis and they are directed to pass through the openings 14. When the cover gets into its position and the protruding elements as well as the cord 20 are overlapped, the shaped protrusions 13 get into their original positions and fix the cover C.

Also, on its bottom part the casing has a groove 16 for guiding the cord 20 and preferably the lateral grooves 15 to facilitate opening of the cover in case of need for handling the cord. The cover is opened simply—the male member is pulled out of the casing, the flat element 5 of male member is inserted in one of the grooves 15 and the cover is detached from the casing by soft levering.

BUCKLE

List of Reference Characters/Signs

A insert (male) member of buckle
1—hanging element of insert member
1.1—opening of hanging element
2—body of insert (male) part (of buckle)
2.1—longitudinal guiding protrusion of rear body part
2.1.1—recess of guiding protrusion
2.2—lateral protrusions of body
2.3—bottom protrusion
3—flexible (shaped) arms
4—shaped protrusions of arms
4.1—lateral surface (of shaped protrusions 4)
4.2—upper surface (of shaped protrusions 4)
5—flat element (for cover opening)
17—flat embossed protrusions of front part of arms
B casing (female part) of buckle
6—guiding groove of front part
7—guiding groove of rear part
8—openings of rear part of casing (for protrusions 4)
9—(inner) shaped surface of casing
9.1—lateral surface of shaped surface 9
9.2—bottom surface of shaped surface 9
10—hanging element (of casing)
11—peg (for string)
11.1—extended part of peg
12—centring element
13—shaped/fixing protrusions
18—openings of front part of casing
19—beak shaped element of front part of casing
20—cord (string)
C cover of casing
14—openings of cover
15—lateral grooves (of cover)
16—groove (for cord/string)

What is claimed is:

1. A buckle comprising a detachable lanyard buckle having an insert male member and a casing female member, wherein the male member comprises a central elongated body with upper and lower ends with flexible arms extending upward and oppositely outward from the lower end of the body and the upper end of the central body having a hanging element, and the female member comprises a hollow casing (B) adapted for accepting the insert member, where the insert male member (A) of the buckle comprises the body (2) having on its upper end the hanging element (1) with an opening (1.1), and having flexibly connected on the lower end of the body lower ends of the flexible arms (3) disposed on both sides of the central elongated body, wherein the body (2) is equipped with a longitudinal guiding protrusion (2.1) on its rear part and the flexible arms (3) are equipped with shaped protrusions (4) situated opposite to each other on the rear part of flexible arms, the casing (B) having a guiding groove (6) on the inner side of its front part for inserting the body (2) of the insert member and having a guiding groove (7) on the inner side of the rear part for inserting the longitudinal protrusion (2.1) of the body (2) of the insert member, wherein the casing (B) is in its rear part equipped with openings (8) for inserting the shaped protrusions (4) of the flexible arms (3), wherein between the openings (8) and guiding groove (7) there is a shaped surface (9) for positioning the shaped protrusions (4) of the flexible arms (3), further, the outer side of the rear part of the casing (B) is equipped with shaped fixing protrusions (13), situated next to the outer sides of openings (8), and with at least one element for hanging and winding a cord (20) for a hung object, wherein the casing further comprises a cover (C) for covering the cord (20) and the elements for its hanging and winding, the cover having openings (14) for inserting the shaped protrusions (13) of the rear part of the casing, and on the bottom part having a groove (16) for guiding the cord (20) and having lateral grooves (15) to facilitate opening of the cover.

2. A buckle according to claim 1, wherein the at least one element for hanging the cord (20) comprises a hanging element (10) situated on the upper end of the outer side of the rear part of the casing.

3. A buckle according to claim 2, wherein the at least one element for winding a cord further comprises a peg (11) with extended part (11.1) situated under the hanging element (10) of the casing.

4. A buckle according to claim 3, wherein the at least one element for hanging and winding the cord further comprises a centering element (12) for central positioning and fixing the cord (20) situated under the peg (11).

5. A buckle according to claim 1, wherein the body (2) of insert member (A) is equipped with lateral protrusions (2.2) for limiting movement of the shaped arms (3) towards the body (2).

6. A buckle according to claim 1, wherein the longitudinal guiding protrusion (2.1) of body (2) of insert member (A) has a shaped longitudinal recess (2.1.1).

7. A buckle according to claim 1, wherein the body (2) of insert member (A) is equipped with a flat element (5) for opening the cover situated on the at least one hanging element (1).

8. A buckle according to claim 1, wherein the front part of the casing (B) is equipped with openings (18) for controlling the position of the flexible arms (3) of insert member (A).

9. A buckle according to claim 1, wherein the flexible arms (3) of insert member (A) are in their front part equipped with embossed protrusions (17) in the openings (18).

* * * * *